US010781069B1

(12) United States Patent
Bookland

(10) Patent No.: US 10,781,069 B1
(45) Date of Patent: Sep. 22, 2020

(54) TURNTABLE PAY-OUT ORGANIZER FOR COILS AND SPOOLS

(71) Applicant: William Bookland, Lahaina, HI (US)

(72) Inventor: William Bookland, Lahaina, HI (US)

( * ) Notice: Subject to any disclaimer, the term of this patent is extended or adjusted under 35 U.S.C. 154(b) by 0 days.

(21) Appl. No.: 16/742,283

(22) Filed: Jan. 14, 2020

Related U.S. Application Data

(63) Continuation-in-part of application No. 16/660,238, filed on Oct. 22, 2019.

(51) Int. Cl.
*B65H 49/30* (2006.01)
*B65H 49/28* (2006.01)
*B65H 57/06* (2006.01)

(52) U.S. Cl.
CPC ..... *B65H 49/30* (2013.01); *B65H 49/28* (2013.01); *B65H 57/06* (2013.01); *B65H 2402/351* (2013.01); *B65H 2701/33* (2013.01); *B65H 2701/34* (2013.01); *B65H 2701/36* (2013.01)

(58) Field of Classification Search
CPC ..... B65H 49/28; B65H 49/30; B65H 54/58
See application file for complete search history.

(56) References Cited

U.S. PATENT DOCUMENTS 3,309,039 A * 3/1967 Rutty ..... B21C 47/20 242/128
3,794,263 A * 2/1974 Delerue ..... B65H 49/30 242/127
3,815,842 A * 6/1974 Scrogin ..... B65H 49/305 242/423.1
2005/0253015 A1* 11/2005 Bohnisch ..... B65H 49/30 242/578

FOREIGN PATENT DOCUMENTS

EP 1586524 A2 * 10/2005 ..... B65H 49/28

* cited by examiner

*Primary Examiner* — William E Dondero
(74) *Attorney, Agent, or Firm* — Dale J. Ream

(57) ABSTRACT

A stackable apparatus for mounting and feeding coiled or spooled wire or cable includes a turntable having a plurality of posts that are length adjustable and positioned in a track, respectively, and configured to guide a coil or receive the spool. Each post includes a post slide portion correspondingly shaped to slide along the track. The apparatus includes a base having a pair of support members each having a longitudinal configuration fixedly attached to one another in a transverse arrangement so as to form conjoined members, the conjoined members defining a bore. A hub in the form of a lazy susan is received in the bore and operable to receive a post depending from the turntable for providing freewheeling rotation of the turntable.

10 Claims, 10 Drawing Sheets

TURNTABLE PAY-OUT ORGANIZER FOR COILS AND SPOOLS

REFERENCE TO RELATED APPLICATIONS

This application claims the priority of non-provisional patent application U.S. Ser. No. 16/660,238 filed Oct. 22, 2019, titled Turntable for Coils and Spools which is incorporated herein its entirety.

BACKGROUND OF THE INVENTION

Field of the Invention

The present invention relates generally to a wire/cable organizer and more specifically to an apparatus for mounting and feeding a spool of wire from a turnable and for spooling unspooled wire onto the turnable creating a coil of wire either dismountable for storage or storing and feeding the coil of wire from the turnable.

Description of the Prior Art

There are other wire organizers which provide for spooled and unspooled wire. While these organizers may be suitable for the purposes for which they where designed, they would not be as suitable for the purposes of the present invention as heretofore described.

It is thus desirable to provide a wire/cable organizer that serves as a turnable dispenser for mounting and feeding spooled wire through a wire/cable organizer aperture. Further, it is desirable to provide a wire/cable organizer for dispending an indeterminate length of loose or uncoiled wire by mounting a free wire/cable end then rotating the turnable until the wire/cable forms a coil of wire that can be dismounted for storage or the organizer can be used as spool and feed for the coiled wire.

SUMMARY OF THE PRESENT INVENTION

The wire/cable organizer is a lightweight device for winding and unwinding lengths of pliable rigid materials including tubing, plastic sheathed, metal clad, steel wire armored cable (SWA and bare wire using turnable fixedly attached to one of the lazy susan swivel with the other member fixedly attached to base that by virtue of centrally positioned and radially arrayed stand-offs, preferably manufactured as a frictional polymeric or elastomeric material that will grip a surface covering, renders base to a static structure allowing free rotation of turnable. Being the static structure, base further serves as device exterior-periphery platform anchor for tensioned members to be moved interiorly defining a desired outward coil boundary limit while winding onto the turnable and aid in maintaining an existing outward boundary limit to an existing coil being payed-out from turnable. Tensioned members are pivotally attached to flange of base by hinges with the tensioning provided by attaching a respective end of spring to flange and flap. One of flanges also serves as product ingress and egress port having feed aperture having grommet.

A primary object of the present invention is to provide a turnable wire/cable organizer and wire/cable feed for either spooled or coiled wire/cable.

Another object of the present invention is to provide a mobile lightweight stationary platform with a turnable enabled with a mechanism for setting diametrically a desired center aperture size and desired outward boundary limit while producing a coil of wire from a controlled source, such as wire from a spool, or an uncontrolled source, such as loose wire.

Yet another object of the present invention is to provide a mobile lightweight stationary platform having the aforementioned enabling mechanism for loose wire where posts, used to establish a loose wire coil aperture size, are contoured with a flat interior side so that when abutting form a small spindle to accommodate small apertured spools.

Still another object of the present invention is to provide the mobile stationary platform with a base having distal end upwardly extending structure having pivotal flaps tensioned through distal ends of a spring attached at one end to the static upwardly extending flanges of the base and the other to the pivotal flap member to dimensionally establish the size of a loose wire coil, as well as, maintain an outward boundary on existing coiled wire or spooled wire as it pays-out from the turnable.

An additional object of the present invention is to provide an ingress and egress port for the wire as it moves to and from the turnable through a feed aperture located in one of the upwardly extending flanges lined with a grommet that may be of a frictional material to add a drag element to the wire moving from or to the freewheeling turnable.

A further object of the present invention is to provide the turnable with radially disposed slidable posts that can be moved to align with the center hole of a spool then mounted onto the turnable and wire/cable dispensed through the feed aperture;

A yet further object of the present invention is to provide the turnable with a bowl-like receptacle work surface comprising a substantially planar portion with a track mounted on spacers diametrically extending across the planar area with the planar area bounded by an upwardly sloping rim capped by an o-ring like ring creating an inwardly depending lip aiding in preventing wire from sliding over the rim.

A still yet further object of the present invention is to the turnable receptacle with a pair of stops transversally positioned relative to the track rail to aid in establishing, in concert with the posts, an ovoid shape while winding onto the turnable an holding an ovoid shape when paying-out wire from the turnable. Optionally provided are telescopic posts increasing the height of the coil's center aperture.

Another object of the present invention is to provide a turnable wire/organizer having tractional non-marring feet aiding in the free-wheeling rotation of the coiled or spooled wire without damaging a floor covering.

Additional objects of the present invention will appear as the description proceeds.

The present invention overcomes the shortcomings of the prior art by providing apparatus for mounting and feeding a spool of wire from a turnable and spooling unspooled wire onto the turnable creating a coil of wire either dismountable for storage or storing and feeding the coil of wire from the turnable.

The foregoing and other objects and advantages will appear from the description to follow. In the description reference is made to the accompanying drawing, which forms a part hereof, and in which is shown by way of illustration specific embodiments in which the invention may be practiced.

These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DETAILED DESCRIPTION OF THE PREFERRED EMBODIMENT

A wire/cable payout organizer for coiled wire or wire wound on a spool will now be described in detail with reference to FIGS. 1 to 10 of the accompanying drawings.

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Figure 1:
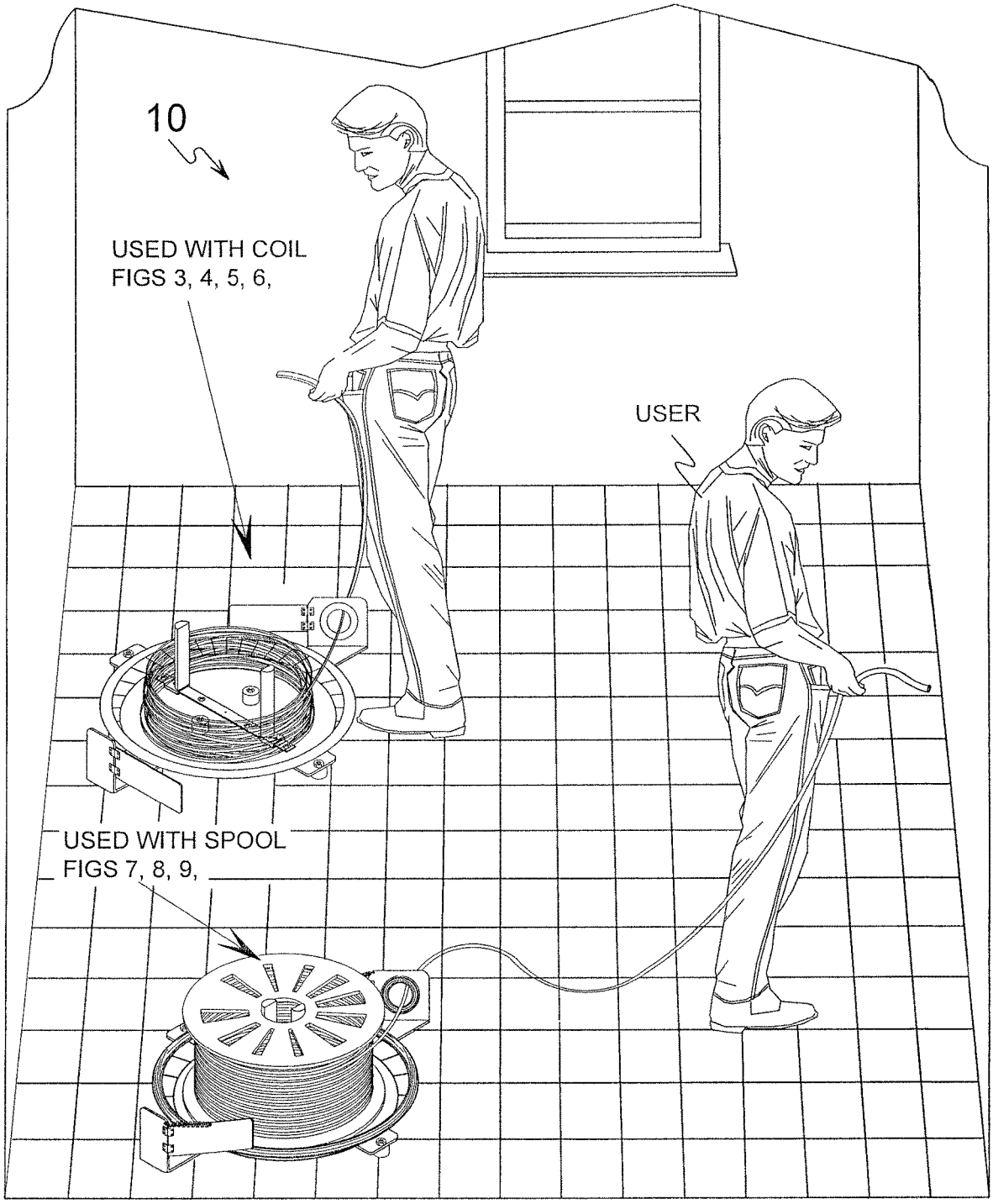
FIG. 1 is a perspective view of a turntable payout organizer according to a preferred embodiment of the present invention in use.

Referring to FIG. 1, shown is an illustrative view of the light turntable payout organizer for coils and spools of the present invention in use. The present invention is a cable spool payout device 10 designed for organizing loose wire into coiled wire and payout coiled wire and/or spool of cable smoothly from the device preventing bird nesting or sliding along a floor surface by virtue of tractional foot pads.

Figure 2:
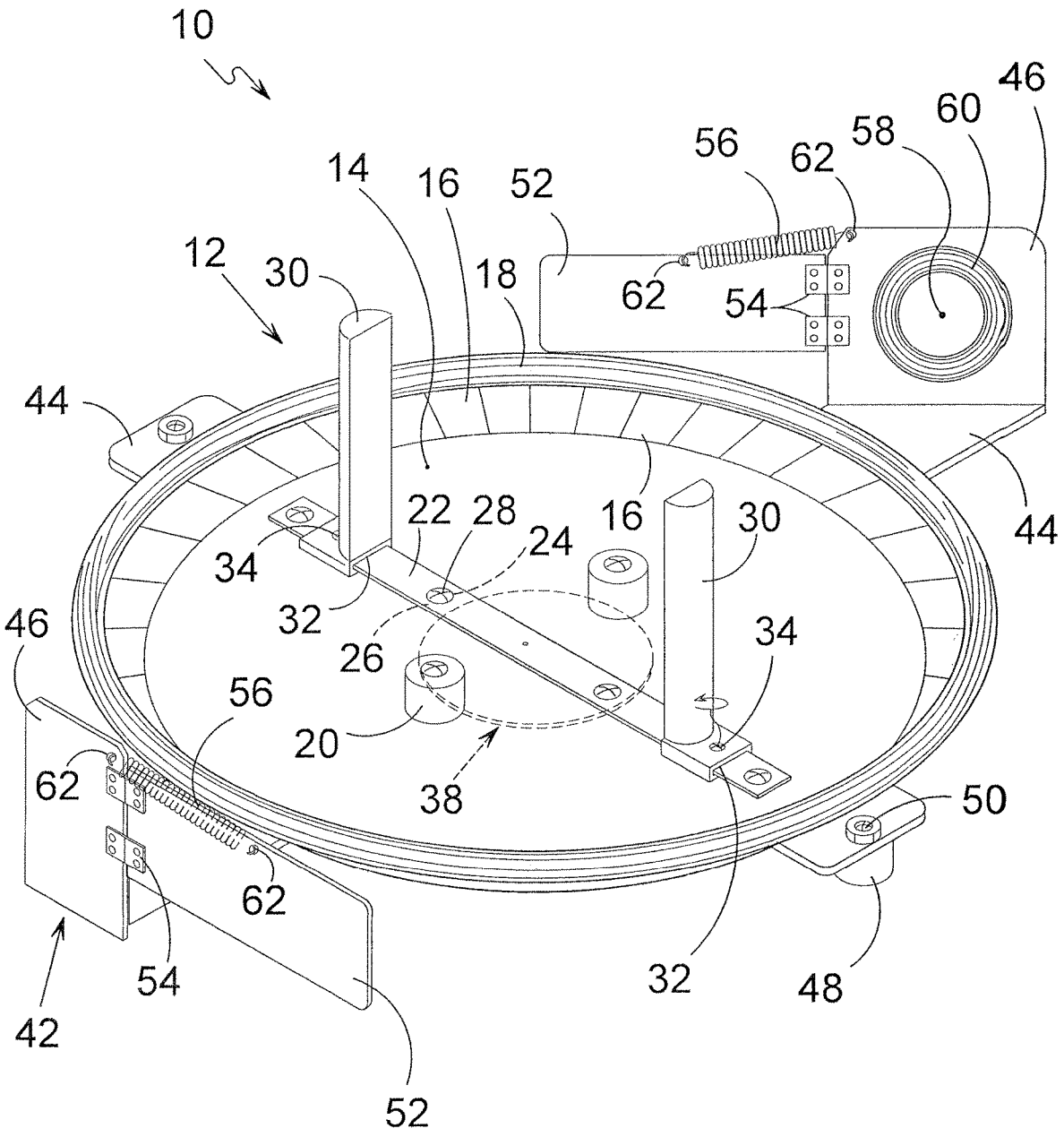
FIG. 2 is a perspective view of the payout organizer as in FIG. 1.

Referring to FIG. 2, shown is an assembled view of the present invention. The present invention is a turnable organizer 10 for spooled and unspooled wire/cable, shown in the accompanying drawings, comprising base 42 having a pair of coplanar transverse members forming structure 44 for fixedly attaching a first side of a lazy susan swivel member 38 and for attaching a plurality of polymeric or elastomeric feet 48 to the underside of 44 via fastener 50 serving as frictional elements to prevent damage to floor coverings and anchor base 42 from movement also of its fixed static portion of lazy susan 38 providing uninhibited rotation of turnable 12. One of the coplanar transverse members of 44 has distal ends extending into vertical flanges 46 serving as static structures for movable flaps 52 secured to flanges 46 by hinges 54 with the flaps tensioned by spring 56 latched at its respective ends 62 to static flange 46 and flap 52 allowing flap 46 to be moved between a disengaged position, as illustrated in the figure, to a turnable wire/cable engaged position, see FIG. 3. One of the vertical flanges also defines a feed aperture 58 through which wire is moved onto and from turnable 12 with feed aperture 58 being lined with grommet 60. The bottom side of turnable 12 has the other side of lazy susan 38 fixedly attached. Attached on the top of turnable 12 is rail 22, which is spaced away from receptacle 14 by one or more spacers 26 and secured to receptacle 14 via fasteners 28 extending through rail fastener apertures 26. Posts 30 are selectively positionable and are upstanding to accommodate coiled loose wire and spooled wire. Each post may have a semicircular cross section or half a cylinder configuration (i.e. half a cylinder) as shown in FIG. 2. More particularly, each post 30 is slidably movable and securable. Each post 30 may have a base flange portion forming post holder 32 for rail 22 and a base flange threaded bore that is a receiver for a thumb screw-like fastener 34 for securely latching post 30 to a desired rail 22 location. Also shown are elements designed to aid in handling loose wire (e.g. coiled wire). Basically, the turnable forms a trough between an outward containment formed by receptacle basin 14 that is solid and closed and peripherally transitioning into outwardly and upwardly extending rim 16 capped with a frictional elastomeric or polymeric o-ring like member 18 (aka a peripheral edge) and the inward containment formed by the selective positioning of post 30 with static structures 20 aiding in forming an ovoid coil shape.

Figure 3:
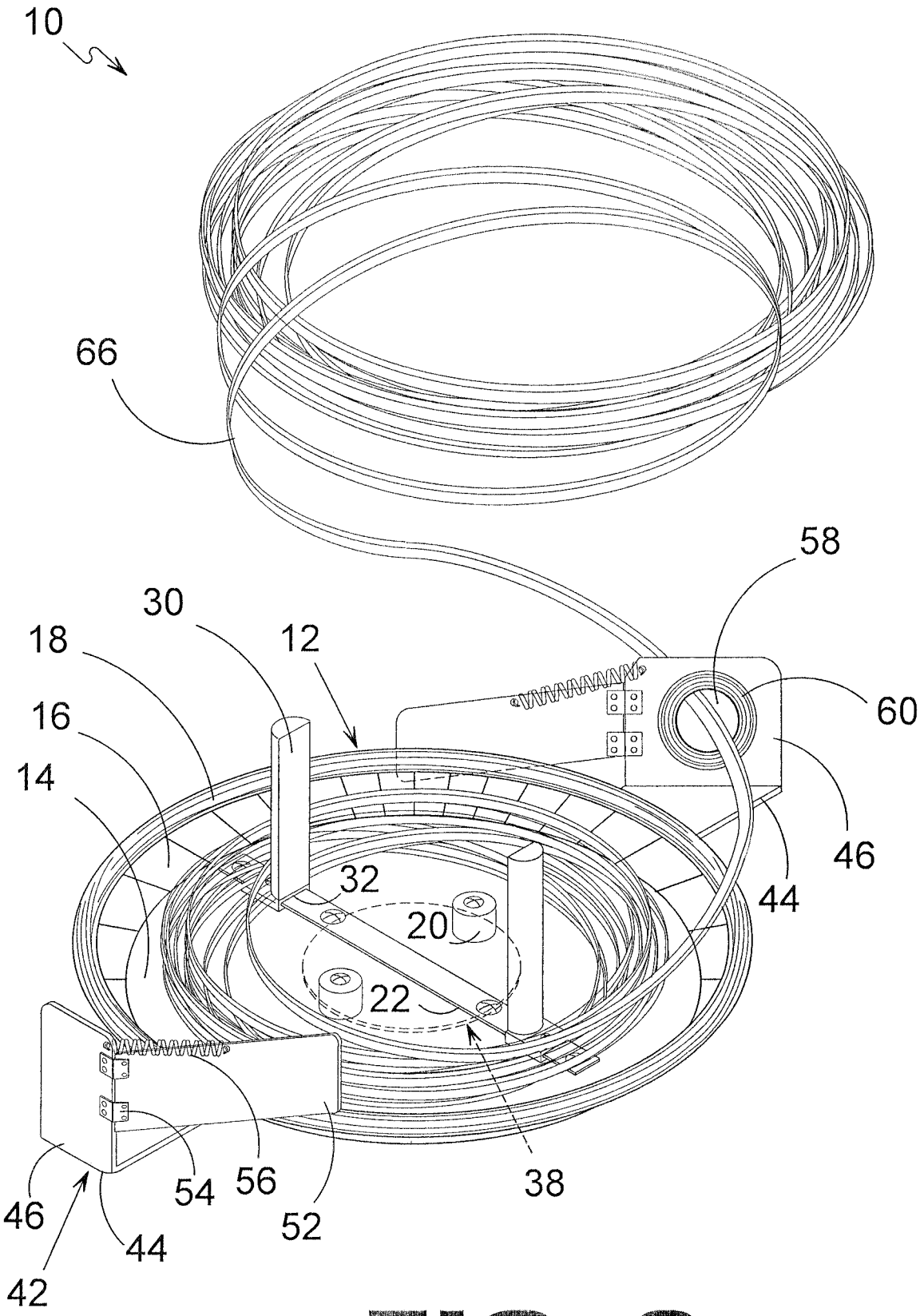
FIG. 3 is an illustrative view of the payout organizer used to organize coiled wire.

Referring to FIG. 3, shown is perspective view of the turnable organizer used to organize loose coiled wire. The organizer 10 serves the dual purpose of spooling coiled wire 66 onto the turnable 12 having receptacle 14 with rim 16 and an o-ring-like ring forming ridge 18 (aka peripheral edge or peripheral rim). The turnable platform includes a track 22 having a linear and elongate configuration extending diametrically between opposed edges of the peripheral rim 16. The pair of posts 30 are movable from a center position to a peripheral position as desired by the user. More particularly, each post 30 may be slidably movable along the track 22 and then latched and secured to the track 22. As illustrated, the coiled wire 66 is contained on the turnable by virtue of the bowl-like turnable and posts.

A base 42 includes a pair of support members, each support member having a planar configuration and having opposed ends. An upstanding flange 46 extends upwardly from the opposed ends of one of the support members 44 of the base 42 and is an anchor for flaps 52 pivotally coupled thereto by a hinge 54 and tensioned by an attached spring 56 connected to the aforementioned flange, such that the flaps 52 are then selectively movable to help contain the coiled wire periphery boundary when receiving a roll of coiled wire or maintaining tension upon a mounted roll of coiled wire while being payed-out.

Figure 4:
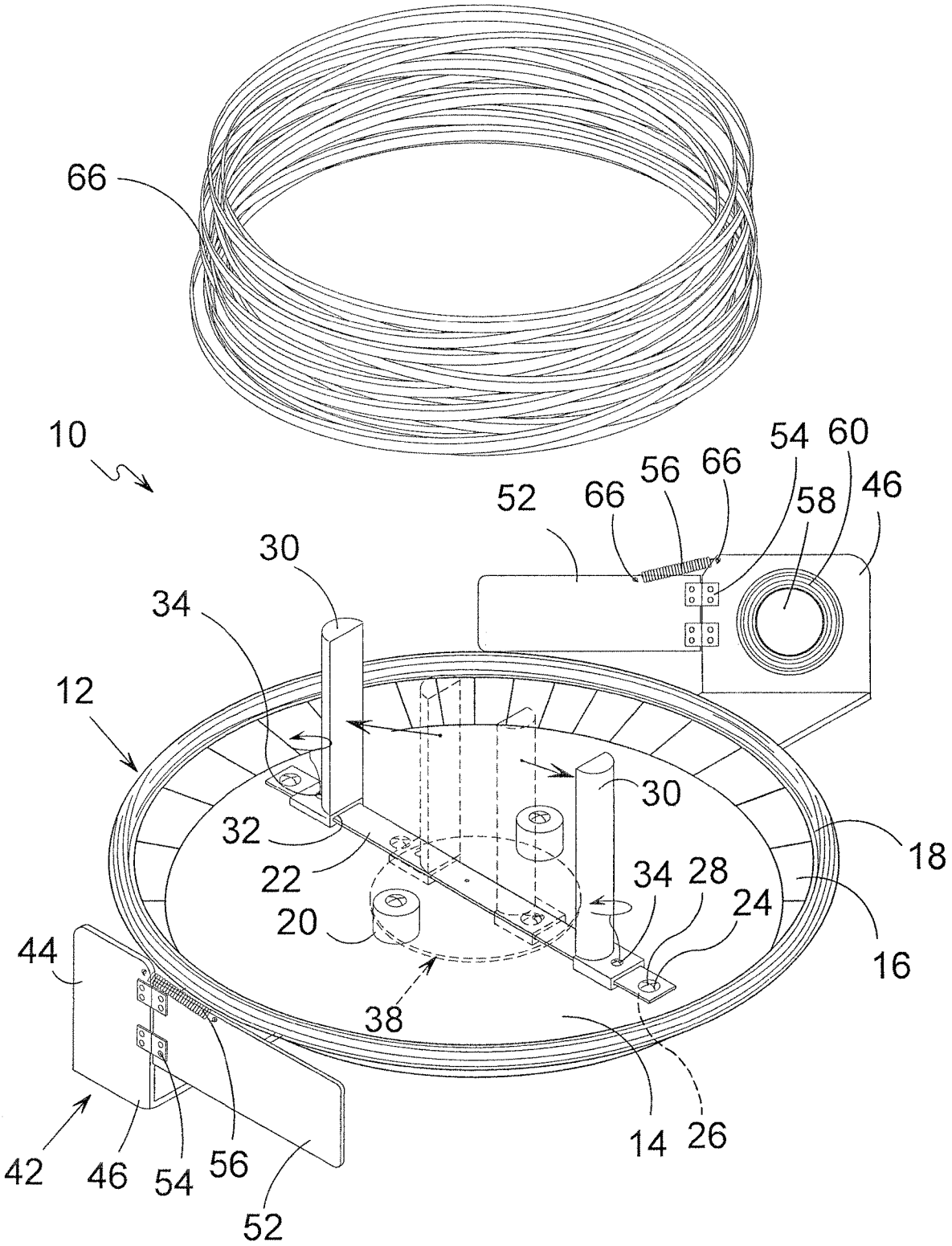
FIG. 4 is a perspective view of the payout organizer setting up for use of rolled coiled wire.

Referring to FIG. 4, shown is a perspective view of organizer setting up for use of rolled coiled wire 66. The turnable organizer 10 can be used either with coiled wire or spooled wire, shown in later drawings, with the main difference being the position of the turnable posts 30. For receiving a roll of coiled wire 66, the posts 30 are approximately positioned to the inner wall of the roll of coiled wire 66 with the vertical flanges 46 and flaps 52 containing the exterior wall of the roll of coiled wire 66.

Figure 5:
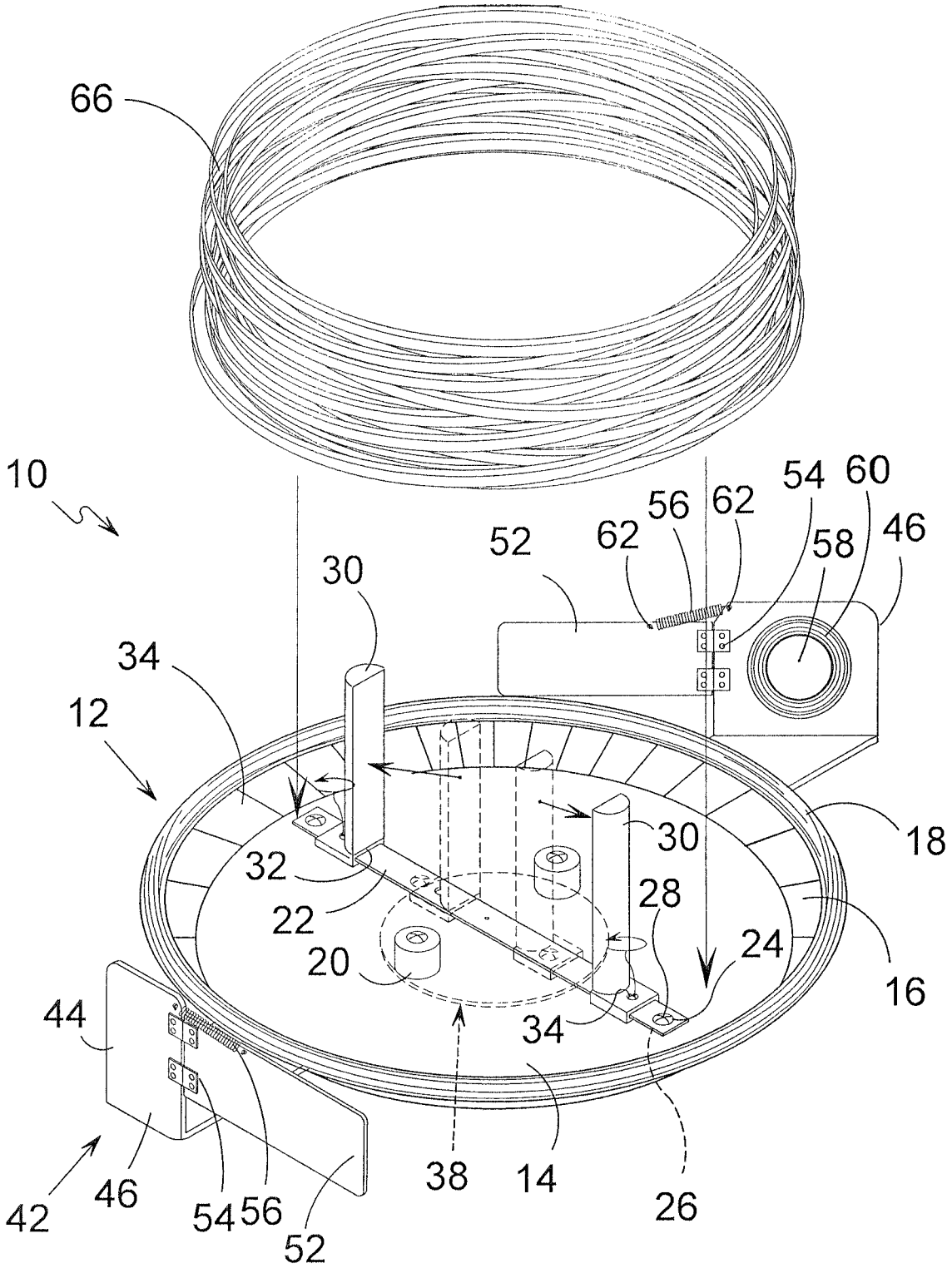
FIG. 5 is another perspective view of the payout organizer setting up for use of rolled coiled wire.

Referring to FIG. 5, another perspective view of the organizer 10 is shown setting up for use of rolled coiled wire 66. Depicted in the turnable posts 30 moved to the approximate inner wall of the roll of coiled wire 66 and a roll of coiled wire ready to be mounted on the turnable platform 12.

Figure 6:
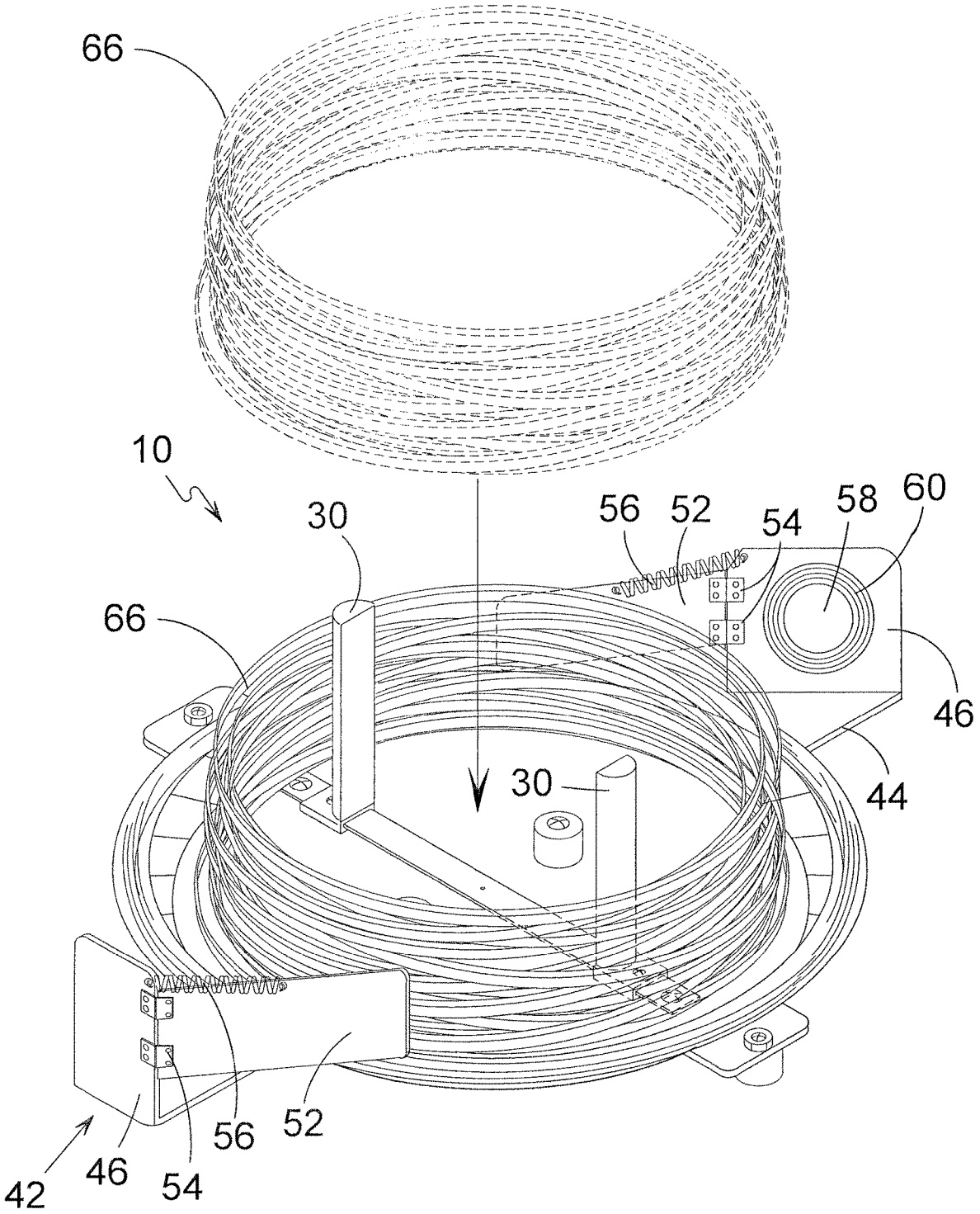
FIG. 6 is another perspective view of the payout organizer set up for use of rolled coiled wire.

Referring to FIG. 6, shown is another perspective view of organizer set up for use with rolled coiled wire. Depicted are the posts 30 moved to a position proximate an inner wall of the roll of coiled wire 66 and a roll of coiled wire 66 mounted on the turnable platform 12.

Figure 7:
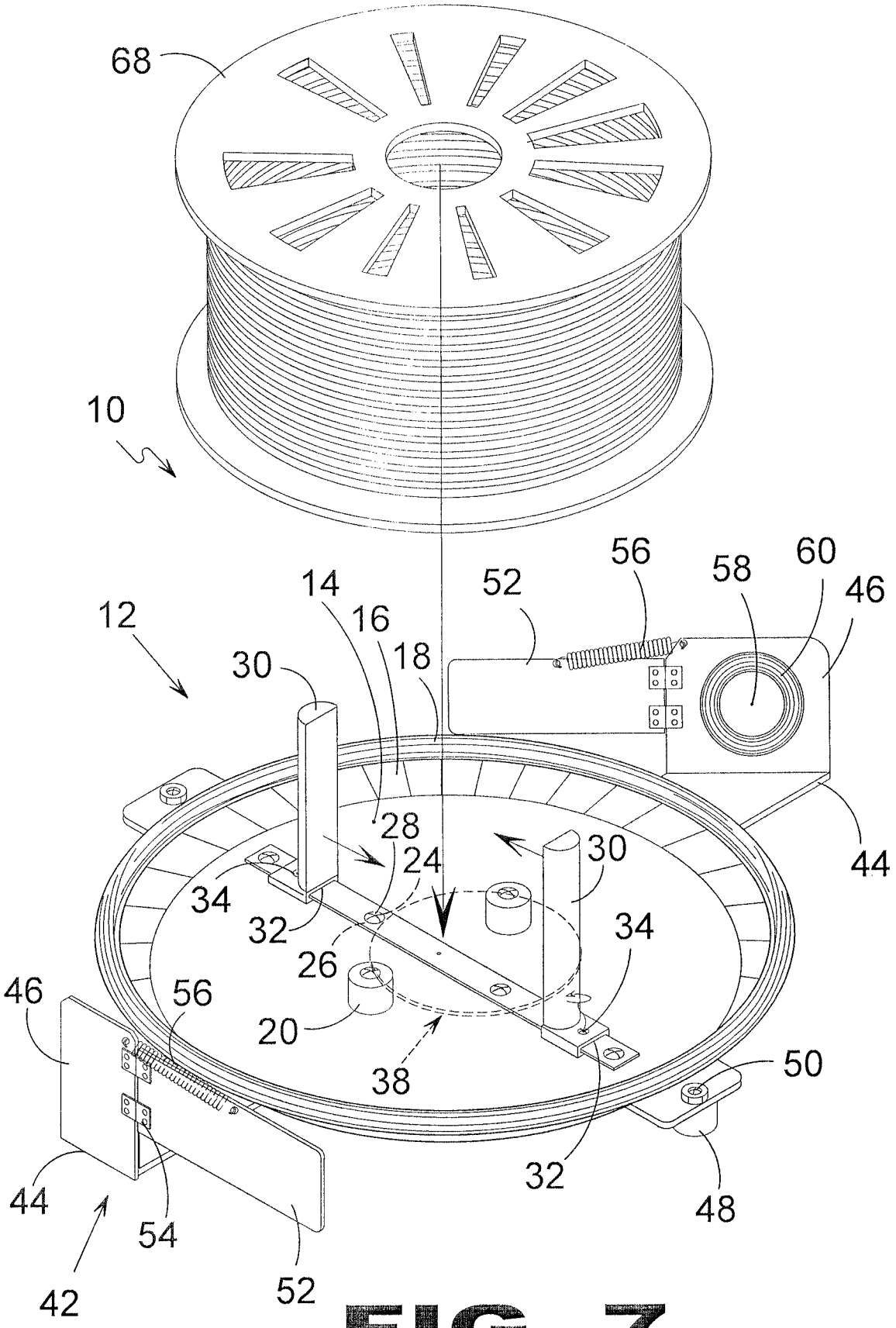
FIG. 7 is a perspective view of the payout organizer setting up for use of spooled wire.

Referring to FIG. 7, shown is a perspective view of organizer setting up for use of spooled wire 68. As aforementioned, the turnable 12 organizer can be used either with coiled wire or spooled wire 68 with the main difference being the position of the turnable posts 30. For spooled wire 68 the posts 30 are approximately positioned to the center spool 68 aperture with the vertical flanges 46 and flaps 52 maintaining tension on the exterior wall of the roll of spooled wire 68 (see FIGS. 8 and 9).

Figure 8:
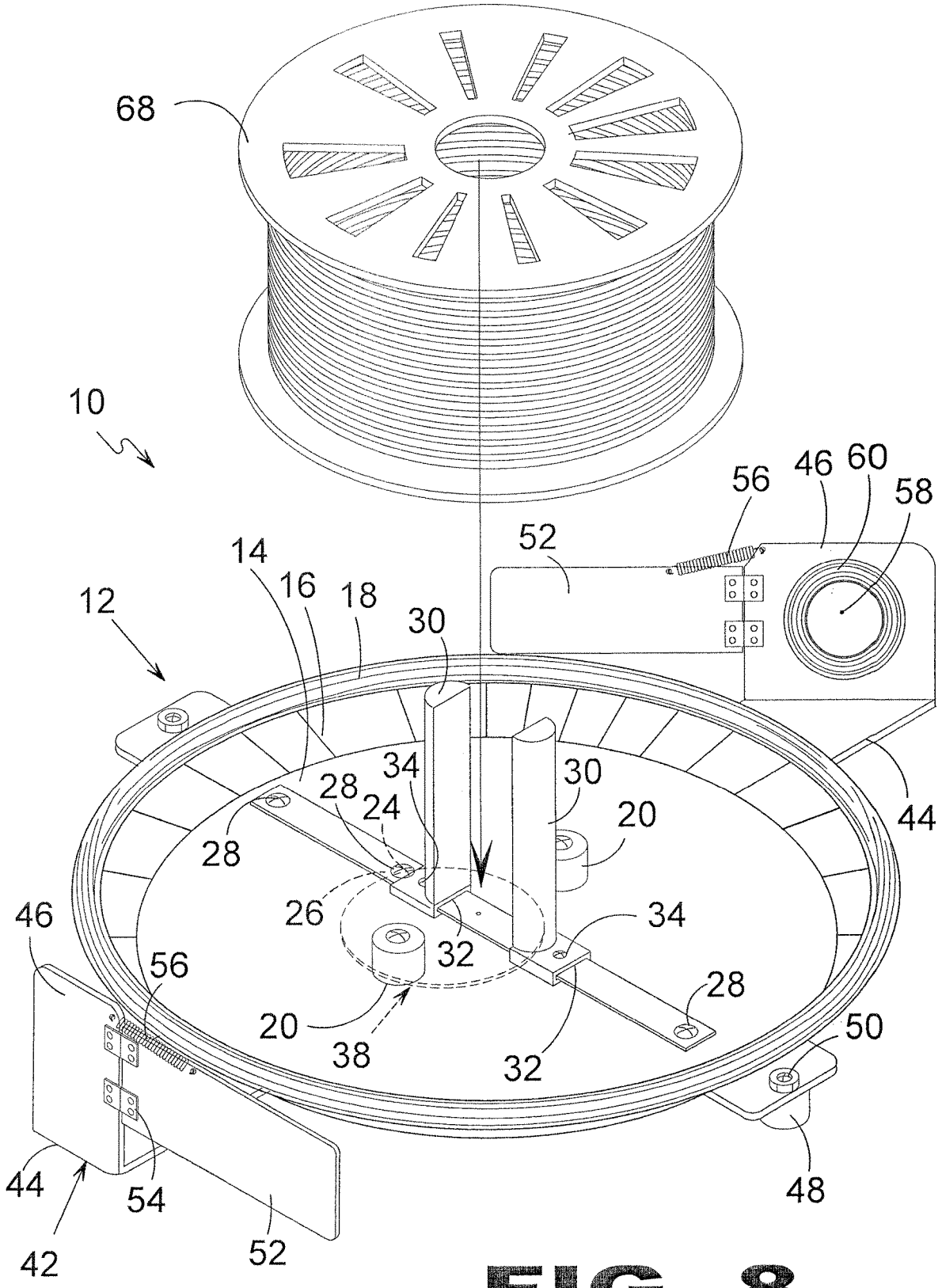
FIG. 8 is a perspective view of the payout organizer setting up for use of spooled wire.

Referring to FIG. 8, shown is a perspective view of a payout organizer 10 setting up for use of spooled wire. A base 42 includes the pair of support members 44 forming structure for securing a first side of a lazy susan swivel member 38 to a top surface of the support members 44 and a second side to turnable 12 described above. It is understood that a lazy susan swivel member 38 is essentially a hub in which the bottom side may be stationary and attached to the support members and a top side having structures that allow a structure coupled thereto to be rotated. Also called a turntable, a lazy susan is a rotating, tray shaped platform usually placed on tables or counters to easily distribute food. A second or top side of the lazy susan swivel member 38 may include a bushing allowing a spool or coiled wire to rotate thereon as will be described later.

In another aspect, the distal ends 46 of one of the coplanar transverse members includes vertical flanges 46 having hinges 54 pivotally attaching flaps 52 tensioned by spring 56 latched at its respective ends to static flange 46 and flap 52 allowing flap 52 to be moved between a disengaged position, as illustrated in the figure, to a turnable wire/cable engaged position. One of the vertical flanges also includes a feed aperture 58 for moving wire onto and from turnable 12 with feed aperture 58 lined with grommet 60.

Figure 9:
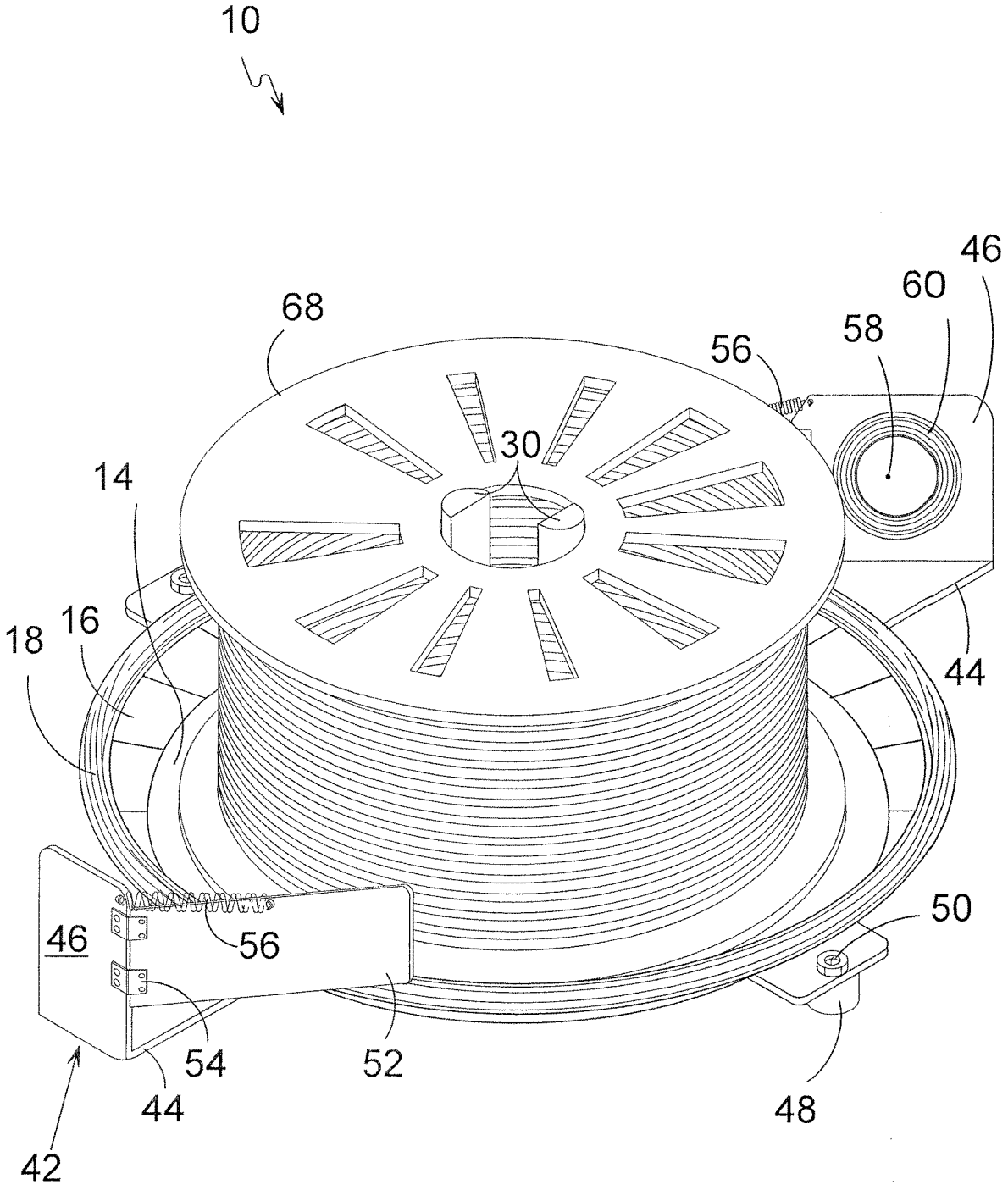
FIG. 9 is a final perspective view of the payout organizer setting up for use of spooled wire.

Referring to FIG. 9, shown is a final perspective view of organizer 10 setting up for use with spooled wire. The spool 68 is positioned on turnable receptacle 14 with posts 30 extending through the spoofs center aperture. Base 42 includes transverse structure 44 supported on a surface by frictional pads 48 attached via fasteners 50 to support member 44.

Each upstanding flange 46 defines a feed aperture 58 that is lined with grommet 60 and which is dimensioned to allow ingress or egress of a wire as the wire moves off or onto the spooled wire with flaps 52 moved into engagement with the spooled wire 68 under tension by spring 56 latched to a respective flange 46 and flap 52.

Figure 10:
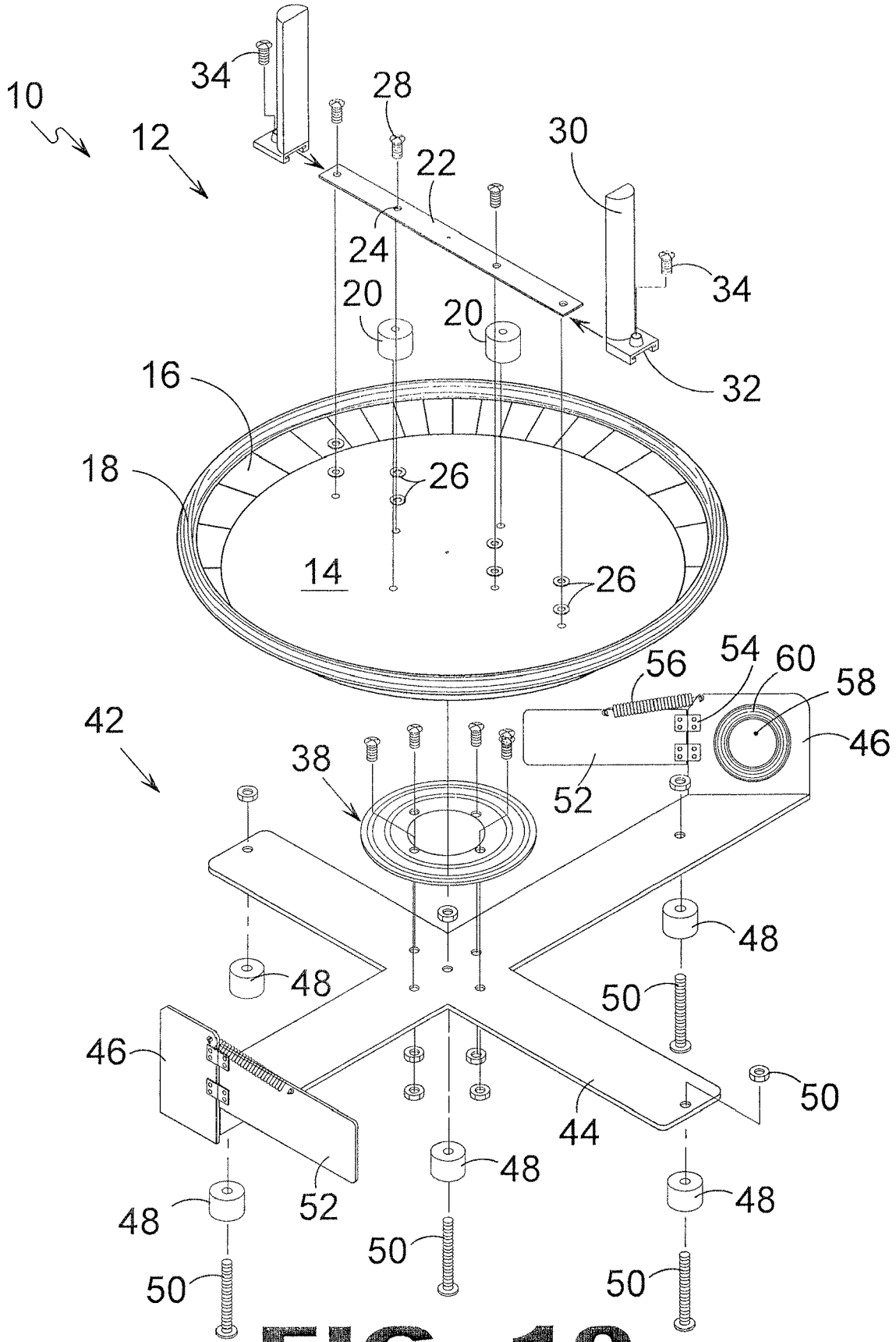
FIG. 10 is an exploded view of the payout organizer as in FIG. 1.

Referring to FIG. 10, shown is an exploded view of the present invention. The organizer 10 is a lightweight device for winding and unwinding lengths of pliable rigid materials including tubing, plastic sheathed, metal clad, steel wire armored cable (SWA and bare wire using turnable 12 fixedly attached to one of the lazy susan swivel 38 with the other member fixedly attached to base 42 that by virtue of centrally positioned and radially arrayed stand-offs 48, preferably manufactured as a frictional polymeric or elastomeric material that will grip a surface covering, renders base 42 to a static structure allowing free rotation of turnable 12. Being the static structure, base 42 further serves as a device exterior-periphery platform anchor for tensioned members 52 to be moved interiorly, defining a desired outward coil boundary limit while winding onto the turnable and aid in maintaining an existing outward boundary limit to an existing coil being payed-out from turnable 12. Tensioned members 52 are pivotally attached to flange 46 of base 44 by hinges 54 with the tensioning provided by attaching a respective end 62 of spring 56 to flange 46 and flap 52. One of flanges 46 also serves as product ingress and egress port having reed aperture 58 having grommet 60.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A turntable payout organizer for receiving a coiled wire or a spool about which a wire or cable is wound, said payout organizer, comprising:

a turntable that includes a receptacle having a bowl-shaped configuration and having a receptacle peripheral rim;

a track having a linear and elongate configuration extending diametrically between opposed edges of said peripheral rim a pair of posts movable between opposed ends of said track;

a base having a pair of support members each having a longitudinal configuration fixedly attached to one another in a transverse configuration so as to form conjoined members, said conjoined members defining a bore; and a lazy susan swivel member having a bottom side coupled to said pair of support members of said base and a top side having a freewheeling portion operably coupled to said receptacle;

wherein said receptacle has a substantially planar portion with said peripheral rim extending outwardly and upwardly for receiving and containing the wire/cable;

wherein said peripheral rim includes an o-ring shaped frictional member forming an inner lip configured to contain the wire/cable.

2. The payout organizer of claim 1, wherein each post of said pair of posts includes a post bottom flange for selectively coupling said each post at a selected position along said track.

3. The payout organizer of claim 2, wherein said each post has a telescopic construction that is length adjustable.

4. The payout organizer of claim 1, wherein said each post has a semicircular cross section configuration so that said pair of posts, when moved to a center position, form a spindle having a cylindrical configuration operable to receive a center aperture of the spool.

5. The payout organizer of claim 1, further comprising a plurality of upstanding flanges mounted to distal ends of said support members of said base, respectfully, and extending upwardly from said support members, respectively.

6. The payout organizer as in claim 1, further comprising a plurality of frictional pads coupled to a bottom surface of said support members of said base for mitigating marring and movement on a floor surface.

7. An adjustable turntable payout organizer for receiving a coiled wire or a spool about which a wire or cable is wound, said payout organizer comprising:

a turntable that includes a receptacle having a bowl-shaped configuration and having a receptacle peripheral rim;

a track having a linear and elongate configuration extending diametrically between opposed edges of said peripheral rim a pair of posts movable between opposed ends of said track;

a base having a pair of support members each having a longitudinal configuration fixedly attached to one another in a transverse configuration so as to form conjoined members, said conjoined members defining a bore; and a lazy susan swivel member having a bottom side coupled to said pair of support members of said base and a top side having a freewheeling portion operably coupled to said receptacle;

a plurality of upstanding flanges mounted to distal ends of said support members of said base, respectfully, and extending upwardly from said support members, respectively;

a pair of flaps, each flap having a proximal edge pivotally coupled to an associated flange, respectively; and a tensioning member extending between said respective flap and said respective flange, said respective flap being urged inwardly by operation of said tensioning member to bear against the coiled wire or the spool and a biased configuration urged outwardly by the coiled wire or the spool.

8. The payout organizer of claim 7, wherein said tensioning member is a spring having one end secured to said respective flap and another end secured to an associated flange so that said respective flap has a normally inward tensioned force.

9. The payout organizer of claim 8, wherein:

said associated flange defines a feed aperture configured to allow ingress or egress of the wire or cable therethrough; and said payout organizer further including a rubber grommet lining said feed aperture.

10. The payout organizer of claim 7, wherein said pair of flaps are pivotally coupled to said pair of flanges with hinges, respectively.

* * * * *